US011407564B2

(12) United States Patent
Pennington et al.

(10) Patent No.: US 11,407,564 B2
(45) Date of Patent: Aug. 9, 2022

(54) CAP ASSEMBLY

(71) Applicant: SAINT-GOBAIN PERFORMANCE PLASTICS CORPORATION, Solon, OH (US)

(72) Inventors: Gerald Mark Pennington, Wesley Chapel, FL (US); Khoa D. Pham, Pinellas Park, FL (US); Thomas R. Nixon, Au Gres, MI (US); Christopher Miller, Midland, MI (US)

(73) Assignee: SAINT-GOBAIN PERFORMANCE PLASTICS CORPORATION, Solon, OH (US)

( * ) Notice: Subject to any disclaimer, the term of this patent is extended or adjusted under 35 U.S.C. 154(b) by 223 days.

(21) Appl. No.: 15/826,984

(22) Filed: Nov. 30, 2017

(65) Prior Publication Data

US 2018/0148231 A1 May 31, 2018

Related U.S. Application Data

(60) Provisional application No. 62/454,205, filed on Feb. 3, 2017, provisional application No. 62/428,362, filed on Nov. 30, 2016.

(51) Int. Cl.
*B65D 41/04* (2006.01)
*B65D 47/06* (2006.01)
(Continued)

(52) U.S. Cl.
CPC ..... *B65D 41/0421* (2013.01); *B65D 39/0076* (2013.01); *B65D 41/0492* (2013.01);
(Continued)

(58) Field of Classification Search
CPC ..... B65D 41/0421; B65D 41/0414; B65D 41/0407; B65D 41/04; B65D 41/02;
(Continued)

(56) References Cited

U.S. PATENT DOCUMENTS 2,099,055 A 11/1937 Ferngren
3,050,218 A * 8/1962 Harvey ..... B65D 7/045 222/498

(Continued)

FOREIGN PATENT DOCUMENTS

JP 2015224054 A 12/2015
WO 2012177250 A1 12/2012
WO 2018102491 A1 6/2018

OTHER PUBLICATIONS

International Search Report and Written Opinion for PCT/US2017/063843 dated Mar. 15, 2018, 13 pages.

*Primary Examiner* — Javier A Pagan
(74) *Attorney, Agent, or Firm* — Abel Schillinger, LLP; Chi Suk Kim

(57) ABSTRACT

The present application is directed to cap assemblies and particularly, cap assembly for closing an opening in a vessel, the cap assembly including a stopper including an polymer body adapted to fit an opening of a vessel, the stopper also including a tubular portion which defines an internal passageway extending through the polymer body; and a rigid
(Continued)

cap attached to and integral with the stopper, wherein the cap is adapted to engage the vessel and provide a sealing force between the stopper and the vessel.

20 Claims, 2 Drawing Sheets

(51) Int. Cl.
*B65D 39/00* (2006.01)
*B65D 51/18* (2006.01)
*B65D 55/02* (2006.01)

(52) U.S. Cl.
CPC ..... *B65D 47/06* (2013.01); *B65D 51/18* (2013.01); *B65D 55/02* (2013.01); *B65D 2251/0015* (2013.01); *B65D 2251/0043* (2013.01)

(58) Field of Classification Search
CPC ..... B65D 41/00; B65D 41/0492; B65D 39/0076; B65D 47/06; B65D 47/061
See application file for complete search history.

(56) References Cited

U.S. PATENT DOCUMENTS

| | | | | |
|---|---|---|---|---|
| 3,223,269 | A | 12/1965 | Williams | |
| 4,821,897 | A | 4/1989 | Weiler | |
| 6,062,440 | A * | 5/2000 | Murray | A01K 7/06 222/464.1 |
| 6,450,367 | B1 * | 9/2002 | Sittler | B65D 47/242 222/39 |
| 6,684,814 | B1 * | 2/2004 | Ver Hage | A01K 7/06 119/72 |
| 6,708,850 | B2 | 3/2004 | Uetake et al. | |
| 2005/0077304 | A1 * | 4/2005 | Connelly | A47G 19/2266 220/709 |
| 2005/0184026 | A1 | 8/2005 | Haley | |
| 2007/0074979 | A1 | 4/2007 | Cho | |
| 2008/0017675 | A1 | 1/2008 | Pressey | |
| 2011/0241262 | A1 | 10/2011 | Siddhamalli et al. | |
| 2014/0263453 | A1 | 9/2014 | Haley et al. | |
| 2014/0367354 | A1 | 12/2014 | Ding et al. | |

* cited by examiner

CAP ASSEMBLY

CROSS-REFERENCE TO RELATED APPLICATION(S)

This application claims priority under 35 U.S.C. § 119(e) to U.S. Patent Application No. 62/428,362 entitled "CAP ASSEMBLY", by Gerald Mark Pennington et al., filed Nov. 30, 2016, and claims priority under 35 U.S.C. § 119(e) to U.S. Provisional Patent Application No. 62/454,205 entitled "CAP ASSEMBLY", by Gerald Mark Pennington et al., filed Feb. 3, 2017, which are assigned to the current assignee hereof and incorporated herein by reference in their entireties.

FIELD OF THE DISCLOSURE

The present disclosure relates to cap assemblies, and more particularly to, cap assemblies for closing an opening in a plastic or glass vessel.

RELATED ART

Cap assemblies can be used to close or seal an opening in vessels, particularly vessels made from plastic or glass. Current designs of cap assemblies have many drawbacks. For example, current designs of cap assemblies may not provide adequate seal integrity. Further, high applied torques are becoming increasingly necessary to provide proper sealing and closure of the opening of the vessel, especially when the fluid in the vessel is under pressure, causing leakage. Further, current designs do not enable complete engagement of the threadings in a cap assembly, leading to the inability to withstand high torque values. For example, during the rapid torqueing of the cap assembly, current designs can have failures such as jumping of the threading and misalignment of the cap assembly with respect to the opening of the vessel. Still further, failures can result from tilting of the cap assembly causing an uneven pressure application about the opening of the vessel.

Further improvements in cap assemblies are needed, particularly in enabling the cap assemblies to withstand high applied torques and achieve substantial seal engagement to the vessel to ensure an adequate seal and minimize leakage and operator error in assembling a seal and retainer within a cap assembly. The following disclosure describes embodiments of a cap assembly which can overcome the disadvantages of the current designs and achieve excellent applied torque thresholds and improved seal engagement resulting in repeatable high performing cap assemblies.

BRIEF DESCRIPTION OF THE DRAWINGS

Embodiments are illustrated by way of example and are not limited in the accompanying figures.

Figure 1:
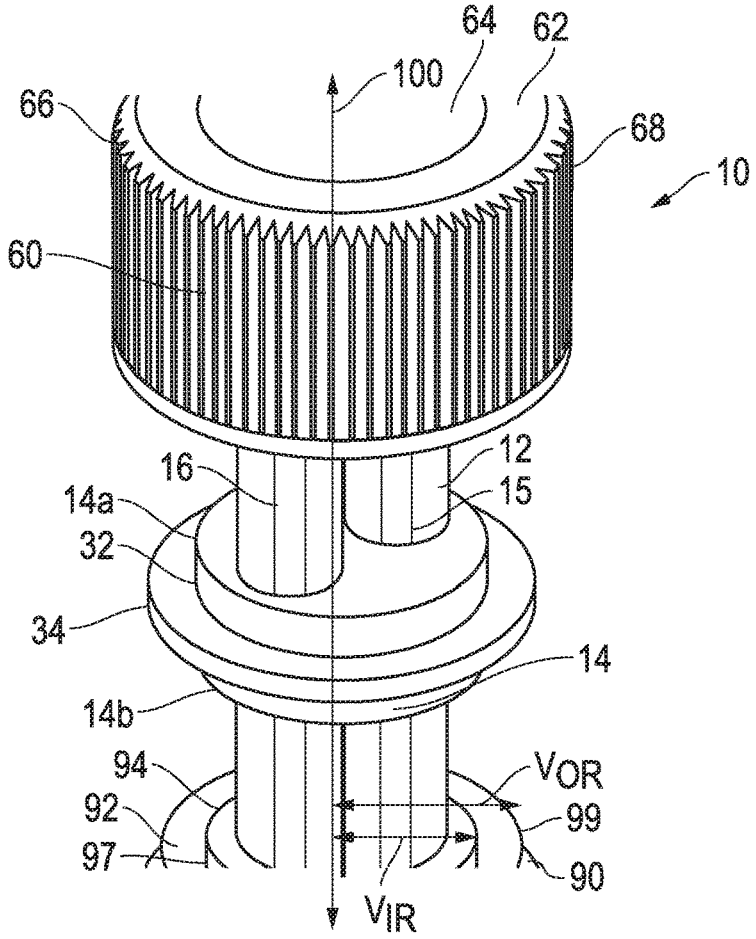
FIG. 1 illustrates an exploded view of a cap assembly according to an embodiment of the present disclosure.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other embodiments can be used based on the teachings as disclosed in this application.

The terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one, at least one, or the singular as also including the plural, or vice versa, unless it is clear that it is meant otherwise. For example, when a single embodiment is described herein, more than one embodiment may be used in place of a single embodiment. Similarly, where more than one embodiment is described herein, a single embodiment may be substituted for that more than one embodiment.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in textbooks and other sources within the vessel sealing arts.

The following disclosure describes cap assemblies adapted to withstand high applied torques and achieve substantial seal engagement to the vessel to ensure an adequate seal and minimize operator error in assembling a seal and retainer within a cap assembly. The concepts are better understood in view of the embodiments described below that illustrate and do not limit the scope of the present invention.

An embodiment discloses a cap assembly for closing an opening in a vessel, the cap assembly including: a stopper including an polymer body adapted to fit an opening of a vessel, the stopper also including a tubular portion which defines an internal passageway extending through the polymer body; an a rigid cap attached to and integral with the stopper, wherein the cap is adapted to engage the vessel and provide a sealing force between the stopper and the vessel.

An embodiment discloses a method for forming a cap, the method including forming a stopper including an polymer body adapted to fit an opening of a vessel, the stopper also including a tubular portion which defines an internal passageway extending through the polymer body; and forming a rigid cap attached to and integral with the stopper, wherein the cap is adapted to engage the vessel and provide a sealing force between the stopper and a vessel.

An embodiment includes the cap assembly or method where the stopper includes a substantially cylindrical section and an annular flange extending outward in the radial direction from the substantially cylindrical section. An embodiment includes the cap assembly or method where the stopper substantially cylindrical section includes a top surface and a bottom surface and the tubular portion extends axially away from the top surface and the bottom surface. An embodiment includes the cap assembly or method where the cap includes a radial flange defining a central bore, and at least one annular axial flange extending from a radial edge of the radial flange and adapted to contact a opening of the vessel. An embodiment includes the cap assembly or method where the stopper forms an integral seal with the radial flange of the cap and substantially fills the central bore. An embodiment includes the cap assembly or method where the annular axial flange has a top surface, a side surface, and a bottom surface. An embodiment includes the cap assembly or method where the cap includes a locking mechanism capable of locking and sealing the cap to the vessel, the locking mechanism including a catch, a latch, or threadings. An embodiment includes the cap assembly or method wherein at least one of the stopper or the cap is a molded piece. An embodiment includes the cap assembly or method where the stopper and the cap are a single molded piece. An embodiment includes the cap assembly or method where a surface of the annular axial flange or the radial flange of the cap is sealed to at least one of the substantially cylindrical section or annular flange of the stopper. An embodiment includes the cap assembly or method where the assembly further includes a vessel having a bottom, a sidewall extending from the bottom, wherein the sidewall includes an opening opposite the bottom for accepting the cap. An embodiment includes the cap or method where the vessel includes at least one of glass, metal, or plastic. An embodiment includes the cap assembly or method where the cap includes a polymer. An embodiment includes the cap assembly or method where the stopper and the cap are formed from the same polymer. An embodiment includes the cap or method where the stopper and the cap are formed from different polymers. An embodiment includes the cap or method where the stopper is formed from a polymer including a fluoropolymer or a thermoplastic polymer or combinations thereof. An embodiment includes the cap assembly or method where the cap is formed from a material including a metal or a polymer including a fluoropolymer or a thermoplastic elastomer or combinations thereof. An embodiment includes the cap assembly or method where at least one of the stopper or cap further includes a silicon compound. An embodiment includes the cap assembly or method where the tubular portion has an outer radius that is less than the outer radius of the annular flange of the stopper. An embodiment includes the cap assembly or method, where the annular flange of the stopper has an outer radius that is less than the inner radius of the cap.

Figure 2:
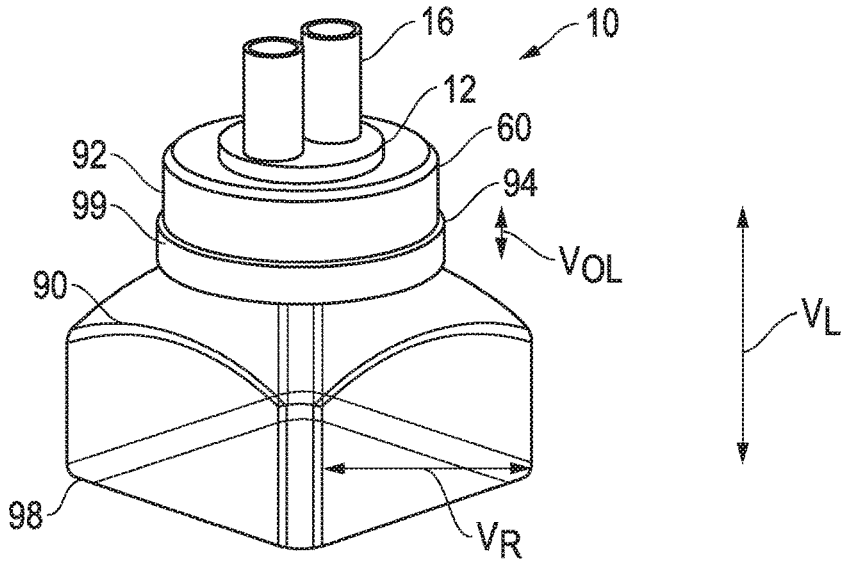
FIG. 2 illustrates a perspective view of an assembled cap assembly according to an embodiment of the present disclosure.
Figure 3:
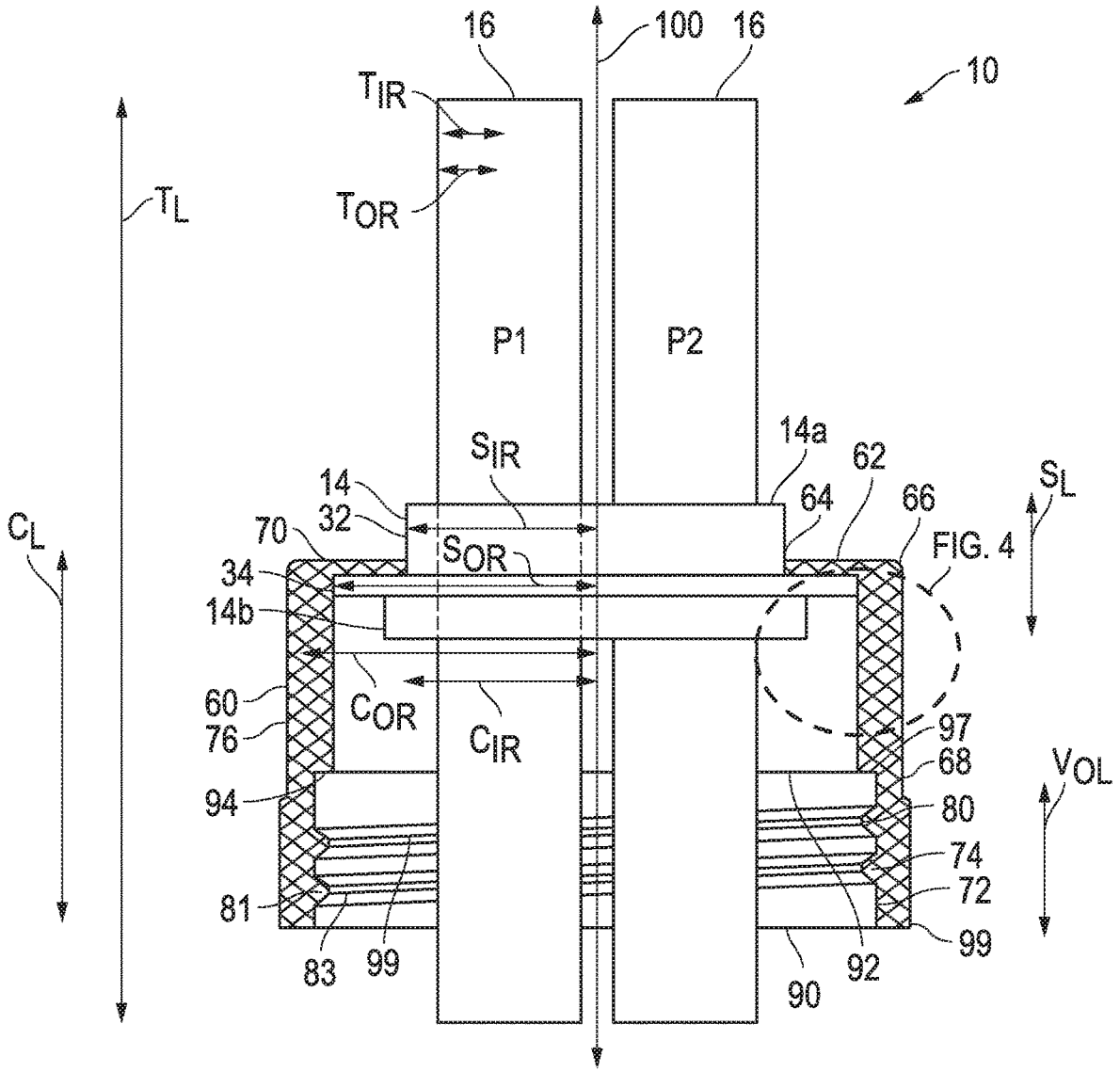
FIG. 3 illustrates a cross section of an assembled cap assembly of an embodiment of the present disclosure.
Figure 4:
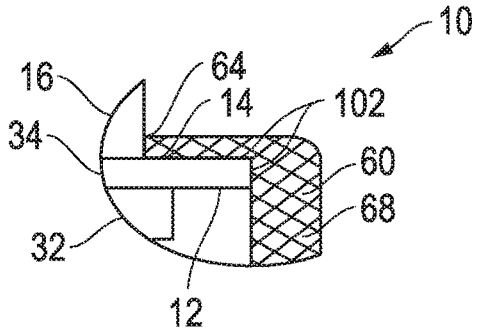
FIG. 4 illustrates a cross section of an assembled cap assembly in accordance with an embodiment of the present disclosure as seen in Circle A of FIG. 3.

FIG. 1 illustrates an exploded view of a cap assembly 10 according to one embodiment of the present disclosure. FIG. 2 illustrates a perspective view of an assembled cap assembly 10 according to an embodiment of the present disclosure. FIG. 3 illustrates a cross section of an assembled cap assembly 10 of an embodiment of the present disclosure. FIG. 4 illustrates a cross section of an assembled cap assembly 10 in accordance with an embodiment of the present disclosure as seen in Circle A of FIG. 3. The cap assembly 10 may have a central axis 100 running down the axial direction of the cap assembly 10. The cap assembly 10 can include a stopper 12. The stopper may include an polymer body 14. The cap assembly 10 can include a cap 60. The cap assembly 10 can include a tubular portion 16. The can assembly 10 can include a vessel 90 having a vessel opening 92 that accepts the cap 60 and/or stopper 12 into contact with the vessel 90.

As best illustrated in FIGS. 1-3, the polymer body 14 may include a top surface 14*a* and a bottom surface 14*b*. The stopper 12 or polymer body 14 may include a substantially cylindrical section 32 and an annular flange 34 extending outward in a radial direction from the substantially cylindrical section 32. The polymer body 14 may be adapted to fit an opening 92 of a vessel 90. In an embodiment, the annular flange 34 may rest on and contact an upper surface 94 of the opening 92 while the substantially cylindrical section 32 may contact or seal an interior surface 97 of the opening 92. The stopper 12 or polymer body 14 may have an inner radius $S_{IR}$ of at least 5 mm, at least 10 mm, at least 15 mm, at least 20 mm, at least 30 mm, at least 40 mm. The stopper 12 or polymer body 14 may have an inner radius $S_{IR}$ that may be no greater than 5 mm, no greater than 10 mm, no greater than 15 mm, no greater than 20 mm, no greater than 30 mm, no greater than 40 mm. The stopper 12 or polymer body 14 may have an outer radius $S_{OR}$ of at least 5 mm, at least 10 mm, at least 15 mm, at least 20 mm, at least 30 mm, at least 40 mm. The stopper 12 or polymer body 14 may have an outer radius $S_{OR}$ that may be no greater than 5 mm, no greater than 10 mm, no greater than 15 mm, no greater than 20 mm, no greater than 30 mm, no greater than 40 mm. Either of the substantially cylindrical section 32 or the annular flange 34 may have an edge that coincides with the inner radius $S_{IR}$ or the outer radius $S_m$. The stopper 12 or polymer body 14 may have an axial length $S_L$ of at least 5 mm, at least 10 mm, at least 15 mm, at least 20 mm, at least 30 mm, at least 40 mm. The stopper 12 or polymer body 14 may have an axial length $S_L$ that may be no greater than 5 mm, no greater than 10 mm, no greater than 15 mm, no greater than 20 mm, no greater than 30 mm, no greater than 40 mm. The stopper 12 or polymer body 14 may include at least one polymer body bore 15 that extends from the top surface 14*a* to the bottom surface 14*b*.

As best illustrated in FIGS. 1-3, the stopper 12 or polymer body 14 may include at least one tubular portion 16. The tubular portion 16 may extend through the polymer body 14 at the polymer body bore 15. The tubular portion 16 may define an internal passageway extending through the polymer body 14. The tubular portion 16 may extend axially away from the top surface 14*a* and the bottom surface 14*b* of the polymer body. The tubular portion 16 may extend into the vessel 90 through the opening 92. The tubular portion 16 may have an inner radius TIR of at least 5 mm, at least 10 mm, at least 15 mm, at least 20 mm, at least 30 mm, at least 40 mm. The tubular portion 16 may have an inner radius TIR that may be no greater than 5 mm, no greater than 10 mm, no greater than 15 mm, no greater than 20 mm, no greater than 30 mm, no greater than 40 mm. The tubular portion 16 may have an outer radius TOR of at least 5 mm, at least 10 mm, at least 15 mm, at least 20 mm, at least 30 mm, at least 40 mm. The tubular portion 16 may have an outer radius TOR that may be no greater than 5 mm, no greater than 10 mm, no greater than 15 mm, no greater than 20 mm, no greater than 30 mm, no greater than 40 mm. The tubular portion 16 may have an axial length TL that may be no greater than 5 mm, no greater than 10 mm, no greater than 15 mm, no greater than 20 mm, no greater than 30 mm, no greater than 40 mm. The tubular portion 16 may have an axial length TL of at least 5 mm, at least 10 mm, at least 15 mm, at least 20 mm, at least 30 mm, at least 40 mm. In an embodiment, the tubular portion 16 may have an outer radius TOR that is less than the inner radius SIR of the annular flange 34 of the stopper 12

As best illustrated in FIGS. 1-3, in an embodiment, the cap assembly 10 can include a cap 60. The cap 60 may be rigid. In an embodiment, the cap may be attached to or integral with the stopper 12. The cap 60 may be adapted to engage a vessel 90 and provide a sealing force between the stopper 12 and the vessel 90. In an embodiment, the cap 60 may include a radial flange 62 defining a central bore 64 and having a radial edge 66. The cap 60 may include an annular axial flange 68 extending from a radial edge 66 of the radial flange 62 and adapted to contact the vessel 90 at a sidewall 96 of the vessel 90, interior surface 97 of the vessel opening 92, or exterior surface 99 of the opening 92. The annular axial flange 68 may include a top surface 70, a bottom surface 72, an inside surface 74, and an outside surface 76. The cap 60 may have an inner radius defining the central bore 64 CIR of at least 5 mm, at least 10 mm, at least 15 mm, at least 20 mm, at least 30 mm, at least 40 mm. The cap 60 may have an inner radius defining the central bore 64 CIR that may be no greater than 5 mm, no greater than 10 mm, no greater than 15 mm, no greater than 20 mm, no greater than 30 mm, no greater than 40 mm. The cap 60 may have an outer radius defining the radial edge 66 COR of at least 5 mm, at least 10 mm, at least 15 mm, at least 20 mm, at least 30 mm, at least 40 mm. The cap 60 may have an outer radius defining the radial edge 66 COR that may be no greater than 5 mm, no greater than 10 mm, no greater than 15 mm, no greater than 20 mm, no greater than 30 mm, no greater than 40 mm. The cap 60 may have axial flange 68 length CL of at least 5 mm, at least 10 mm, at least 15 mm, at least 20 mm, at least 30 mm, at least 40 mm. The cap 60 may have axial flange 68 length CL that may be no greater than 5 mm, no greater than 10 mm, no greater than 15 mm, no greater than 20 mm, no greater than 30 mm, no greater than 40 mm. In an embodiment, the annular flange 34 of the stopper 12 may have an outer radius SOR that is less than the inner radius CIR of the cap 60.

In an embodiment, as shown in FIGS. 1-3, the cap assembly 10 may include a vessel or container 90. The vessel 90 may include a bottom 98, a top 94, and at least one sidewall 96 extending from the bottom. The sidewall 96 may have a circular, non-round, polygonal, or oval cross-sectional shape. The vessel 90 may have a radius VR that may be no greater than 5 mm, no greater than 10 mm, no greater than 15 mm, no greater than 20 mm, no greater than 30 mm, no greater than 40 mm. The vessel 90 may have a radius VR of at least 5 mm, at least 10 mm, at least 15 mm, at least 20 mm, at least 30 mm, at least 40 mm. The vessel 90 may have an axial length VL that may be no greater than 5 mm, no greater than 10 mm, no greater than 15 mm, no greater than 20 mm, no greater than 30 mm, no greater than 40 mm. The vessel 90 may have an axial length VL of at least 5 mm, at least 10 mm, at least 15 mm, at least 20 mm, at least 30 mm, at least 40 mm. In an embodiment, the sidewall 96 may have a circular, oval, polygonal, or non-round cross-section. The sidewall 96 may be cylindrical. In an embodiment, the cross-sectional shape of the sidewall 96 can vary along the axial length of the vessel 90. The cap assembly 10 described herein can be used with any desired vessel 90. In particular embodiments, the vessel 90 can formed of a material including, metal, plastic, glass, or combinations thereof. In certain embodiments, the vessel 90 can be formed of a material including plastic or glass.

In an embodiment, the vessel 90 may include an opening 92. The opening 92 may be opposite the bottom 98 of the vessel 90. The opening 92 may be adapted to accept the cap 14. The opening 92 may have an interior surface 97 and an exterior surface 99. In an embodiment, the cap assembly 10 can be adapted to engage with, seal, and close an opening 92 in a vessel 90. The vessel opening 92 may have an inner radius $V_{IR}$ of at least 5 mm, at least 10 mm, at least 15 mm, at least 20 mm, at least 30 mm, at least 40 mm. The vessel opening 92 may have an inner radius $V_{IR}$ that may be no greater than 5 mm, no greater than 10 mm, no greater than 15 mm, no greater than 20 mm, no greater than 30 mm, no greater than 40 mm. The vessel opening 92 may have an outer radius $V_{OR}$ of at least 5 mm, at least 10 mm, at least 15 mm, at least 20 mm, at least 30 mm, at least 40 mm. The vessel opening 92 may have an outer radius $V_{OR}$ that may be no greater than 5 mm, no greater than 10 mm, no greater than 15 mm, no greater than 20 mm, no greater than 30 mm, no greater than 40 mm. The vessel opening 92 may have a vessel opening axial length $V_{OL}$ of at least 5 mm, at least 10 mm, at least 15 mm, at least 20 mm, at least 30 mm, at least 40 mm. The vessel opening 92 may have a vessel opening axial length $V_{OL}$ that may be no greater than 5 mm, no greater than 10 mm, no greater than 15 mm, no greater than 20 mm, no greater than 30 mm, no greater than 40 mm.

As best illustrated in FIGS. 1-3, in an embodiment, the cap 60 may include a locking mechanism 80. The locking mechanism 80 may be adapted to lock and seal the cap 60 or cap assembly 10 to the vessel 90 through locking the cap 60 to the vessel opening 92. The locking mechanism 80 may be engaged physically through manual, mechanical, or automatic means to lock and seal the cap 60 or cap assembly 10 to the vessel 90 through locking the cap 60 to the vessel opening 92. In an embodiment, the locking mechanism 80 may include threads or threadings 81 on the inside surface 74 of the annular axial flange 68 of the cap 60 that couple to threads or threadings 83 on the exterior surface 99 of the vessel opening 92. In another embodiment, the locking mechanism 80 may include a latch adapted to contact and seal to a groove or projection on the vessel opening 92. In an embodiment, the locking mechanism 80 may include a catch adapted to contact and seal to a groove or projection on the vessel opening 92. The locking mechanism 80 may include screw threads or threadings, bolts, battens, buckle, clamp, clip, flange, frog, grommet, hook-and-eye, latch, peg, nail, rivet, screw anchor, snap fastener, stitch, threaded fastener, tie, toggle bolt, wedge anchor, pin, groove and stop, nut and bolt, nut and screw, latch, handle, locking nut, tie rivet, or may be coupled a different way between the cap 60 and the vessel opening 92. In an embodiment, the locking mechanism 80 may hermetically seal the cap assembly 10 to the vessel opening 92.

In particular embodiments, the threads or threadings on the locking mechanism 80 or the vessel opening 92 on the first ring, second ring, and combinations thereof can also have a desired number of threads per inch, referred to herein as TPI. The threads or threadings on the locking mechanism 80 or the vessel opening 92 of the embodiments described herein can have a TPI of at least about 1 TPI, at least about 2 TPI, at least about 3 TPI, at least about 4 TPI, at least about 5 TPI, at least about 6 TPI, at least about 7 TPI, at least about 10 TPI, at least about 15 TPI, or even at least about 20 TPI. Further, the threads or threadings on the locking mechanism 80 or the vessel opening 92 have a threads per inch (TPI) of no greater than about 100 TPI, no greater than about 50 TPI, or even no greater than about 10 TPI. Moreover, the threads or threadings on the locking mechanism 80 or the vessel opening 92 can have a TPI within a range between any of the maximum and minim values described above.

In an embodiment the threads or threadings on the locking mechanism 80 or the vessel opening 92 can form a helical pattern about at least one of the exterior surface 99 of the vessel opening 92 or inside surface 74 of the annular axial flange 68 of the cap 60. The threads or threadings 81, 83 on the locking mechanism 80 and the vessel opening 92 can form a helical mating pattern so they may lock to each other. The threadings 81 on the locking mechanism 80 may be placed on an outside surface 76 or inside surface 74 of the annular axial flange 68 of the cap 60. The threadings 83 on the vessel opening 92 may be placed on an exterior surface 99 or interior surface 97 of the vessel opening 92. Further, the threadings 81, 83 can be described by the number of times the threads wrap around or within the locking mechanism 80 or the vessel opening 92.

In an embodiment, at least one of the stopper 12, polymer body 14, tubular portion 16, or cap 60 may comprise a polymer. At least one of the stopper 12, polymer body 14, tubular portion 16, or cap 60 may comprise at least one polymeric polymer. At least one of the stopper 12, polymer body 14, tubular portion 16, or cap 60 may include a blend of polymers or polymeric polymers including any of the polymers recited herein. The at least one of the stopper 12, polymer body 14, or tubular portion 16 may include a thermoplastic elastomeric hydrocarbon block copolymer, a polyether-ester block co-polymer, a thermoplastic polyamide elastomer, a thermoplastic polyurethane elastomer, a thermoplastic polyolefin elastomer, a thermoplastic vulcanizate, an olefin-based co-polymer, an olefin-based terpolymer, a polyolefin plastomer, or combinations thereof. The stopper or polymer body 14 may include a styrene based block copolymer such as styrene-butadiene, styrene-isoprene, blends or mixtures thereof, mixtures thereof, and the like. Exemplary styrenic thermoplastic elastomers include triblock styrenic block copolymers (SBC) such as styrene-butadiene-styrene (SBS), styrene-isoprene-styrene (SIS), styrene-ethylene butylene-styrene (SEBS), styrene-ethylene propylene-styrene (SEPS), styrene-ethylene-ethylene-butadiene-styrene (SEEBS), styrene-ethylene-ethylene-propylene-styrene (SEEPS), styrene-isoprene-butadiene-styrene (SIBS), or combinations thereof. Commercial examples include some grades of Kraton™ and Hybrar™ resins.

In an embodiment, at least one of the stopper 12, polymer body 14, tubular portion 16, or cap 60 may include a polyolefin polymer. A typical polyolefin may include a homopolymer, a copolymer, a terpolymer, an alloy, or any combination thereof formed from a monomer, such as ethylene, propylene, butene, pentene, methyl pentene, hexene, octene, or any combination thereof. In an embodiment, the polyolefin polymer may be copolymers of ethylene with propylene or alpha-olefins or copolymers of polypropylene with ethylene or alpha-olefins made by metallocene or non-metallocene polymerization processes. Commercial polyolefin examples include Affinity™, Engage™, Flexomer™, Versify™, Infuse™, Exact™, Vistamaxx™ Softel™ and Tafmer™, Notio™ produced by Dow, ExxonMobil, Londel-Basell and Mitsui. In an embodiment, the polyolefin polymer may include copolymers of ethylene with polar vinyl monomers such as acetate (EVA), acrylic acid (EAA), methyl acrylate (EMA), methyl methacrylate (EMMA), ethyl acrylate (EEA) and butyl acrylate (EBA). Exemplary suppliers of these ethylene copolymer resins include DuPont, Dow Chemical, Mitusi and Arkema etc. In another embodiment, the polyolefin polymer can be a terpolymer of ethylene, maleic anhydride and acrylates such as Lotader™ made by Arkema and Evalloy™ produced by DuPont. In yet another embodiment, the polyolefin polymer can be an ionomer of ethylene and acrylic acid or methacrylic acid such as Surlyn™ made by DuPont. In an embodiment, the polyolefin is a reactor grade thermoplastic polyolefin polymer, such as P6E2A-005B available from Flint Hills Resources. In very particular embodiments, the thermoplastic tube can include a C-FLEX® brand biopharmaceutical tubing (available from Saint-Gobain Performance Plastics Corporation at Clearwater, Fla., USA). In the certain embodiments, at least one of the stopper 12, polymer body 14, tubular portion 16, or cap 60 may include, but are not limited to, thermoplastic, thermosets, fluropolymers, and combinations thereof. Specific examples of suitable polymer material can be polyvinyldiene fluoride (PVDF). In the certain embodiments, at least one of the stopper 12, polymer body 14, tubular portion 16, or cap 60 can be formed of a thermoplastic elastomer, silicone, or combinations thereof. For example, specific types of thermoplastic elastomers can be those described in U.S. Patent Application Publication No. 2011/0241262, which is incorporated herein by reference, in its entirety, for all useful purposes.

In an embodiment, at least one of the stopper 12, polymer body 14, tubular portion 16, or cap 60 may comprise a fluoropolymer. The at least one of the stopper 12, polymer body 14, or tubular portion 16 may include a polymer including at least one of polytetrafluoroethylene (PTFE), modified polytetrafluoroethylene (mPTFE), ethylene-tetrafluoroethylene (ETFE), perfluoroalkoxyethylene (PFA), tetrafluoroethylene-hexafluoropropylene (FEP), tetrafluoroethylene-perfluoro (methyl vinyl ether) (MFA), polyvinylidene fluoride (PVDF), ethylene-chlorotrifluoroethylene (ECTFE), polyimide (PI), polyamidimide (PAI), polyphenylene sulfide (PPS), polyethersulofone (PES), polyphenylene sulfone (PPSO2), liquid crystal polymers (LCP), polyetherketone (PEK), polyether ether ketones (PEEK), aromatic polyesters (Ekonol), of polyether-ether-ketone (PEEK), polyetherketone (PEK), liquid crystal polymer (LCP), polyamide (PA), polyoxymethylene (POM), polyethylene (PE)/UHMPE, polypropylene (PP), polystyrene, styrene butadiene copolymers, polyesters, polycarbonate, polyacrylonitriles, polyamides, styrenic block copolymers, ethylene vinyl alcohol copolymers, ethylene vinyl acetate copolymers, polyesters grafted with maleic anhydride, polyvinylidene chloride, aliphatic polyketone, liquid crystalline polymers, ethylene methyl acrylate copolymer, ethylene-norbomene copolymers, polymethylpentene and ethylene acyrilic acid copoloymer, mixtures, copolymers and any combination thereof.

In an embodiment, at least one of the stopper 12, polymer body 14, tubular portion 16, or cap 60 may include a metal or metal alloy. In an embodiment, the metal may be aluminum, iron, tin, platinum, titanium, magnesium, alloys thereof, or maybe a different metal. Further, the metal can include steel. The steel can include stainless steel, such as austenitic stainless steel. Moreover, the steel can include stainless steel comprising chrome, nickel, or a combination thereof. For example, the steel can X10CrNi18-8 stainless steel.

Further, at least one of the stopper 12, polymer body 14, tubular portion 16, or cap 60 can include one or more additives. For example, the one or more additives can include a plasticizer, a catalyst, a silicone modifier, a silicon component, a stabilizer, a curing agent, a lubricant, a colorant, a filler, a blowing agent, another polymer as a minor component, or a combination thereof. In a particular embodiment, the plasticizer can include mineral oil.

In an embodiment, at least one of the stopper 12, polymer body 14, tubular portion 16, or cap 60 or combinations thereof can be formed as a single piece or may be formed as multiple pieces. In an embodiment, at least one of the stopper 12, polymer body 14, tubular portion 16, or cap 60 or combinations thereof can be a molded component. In an embodiment, at least one of the stopper 12, polymer body 14, tubular portion 16, or cap 60 or combinations thereof can be a single molded component forming the cap assembly 10. In an embodiment, at least one of the stopper 12, polymer body 14, tubular portion 16, or cap 60 or combinations thereof can be separate molded cap assembly 10 components forming the cap assembly 10 through over-molding or other methods known in the art. In an embodiment, as shown best in FIG. 4 the polymer body 14 of the stopper 12 may form an integral seal 102 with at least one of the radial flange 62 or annular axial flange 68 of the cap 60 and may substantially fill the central bore 64. The annular flange 34 may contact above or below the central bore 64 in the axial direction while the substantially cylindrical 32 may substantially fill the central bore 64. In an embodiment, as shown in FIG. 4, the surface of the annular axial flange 68 or the radial flange 62 of the cap 60 is sealed to at least one of the substantially cylindrical section 32 or annular flange 34 of the stopper 12 to form an integral seal 102 between the cap 60 and the stopper 12. In a number of embodiments, the seal may be formed by molding, use of an adhesive, welding, mechanical attachment, or may be sealed a different way.

In an embodiment, the polymer or polymeric blend included in at least one of the stopper 12, polymer body 14, tubular portion 16, or cap 60 or combinations thereof may be processed by any known method to form the polymeric mixture. The polymer or polymeric blend may be melt processed by dry blending or compounding. The dry blend may be in powder, granular, or pellet form. The blend can be made by a continuous twin-screw compounding process or batch related Banbury process. Pellets of these mixtures may then be fed into a single screw extruder to make articles such as flexible tubing products. Mixtures can also be mixed in a single-screw extruder equipped with mixing elements and then extruded directly into articles such as tubing products. In a particular embodiment, the mixture can be melt processed by any method envisioned known in the art such as laminating, casting, molding, extruding, and the like. In an embodiment, the mixture can be injection molded.

In an embodiment the polymer or polymeric blend can advantageously withstand sterilization processes. In an embodiment, the polymer or polymeric blend may be sterilized by any method envisioned. For instance, the polymer or polymeric blend is sterilized after the cap assembly 10 is formed. Exemplary sterilization methods include steam, gamma, ethylene oxide, E-beam techniques, combinations thereof, and the like. In a particular embodiment, the polymer or polymeric blend is sterilized by gamma irradiation. For instance, the polymer or polymeric blend may be gamma sterilized at between about 25 kGy to about 55 kGy. In a particular embodiment, the polymer or polymeric blend is sterilized by steam sterilization. In an exemplary embodiment, the polymer or polymeric blend is heat-resistant to steam sterilization at temperatures up to about 130° C. for a time of up to about 45 minutes. In an embodiment, the polymer or polymeric blend is heat resistant to steam sterilization at temperatures of up to about 135° C. for a time of up to about 15 minutes.

In an embodiment, the polymer or polymeric blend can be welded. Notably, "welding" refers to welding two portions of the cap assembly 10 (including, but not limited to, the stopper 12, cap 60, or tubular portion 16) of the cap assembly formed of the polymer or polymeric blend together. Further, welding includes flat seals as well as circumferential seals for tubing applications. Energy is typically applied with parameters sufficient to yield a seal that withstands a seal integrity pressure test of about 30 psi air pressure for about 30 minutes under dry and wet conditions. Any other welding/sealing methods can be envisioned, for example, welding by heat, vibration, ultrasonic, infrared, radiofrequency (RF), combinations thereof, and the like. In an embodiment, the cap assembly 10 or its components may be hermetically sealed to each other.

In an embodiment, the polymer or polymeric blend may be formed into a single layer article, a multi-layer article, or can be laminated, coated, or formed on a substrate to form the cap assembly 10. Multi-layer articles may include layers such as reinforcing layers, adhesive layers, barrier layers, chemically resistant layers, metal layers, any combination thereof, and the like. The polymer or polymeric blend can be formed into any useful shape such as film, sheet, tubing, and the like to form the cap assembly 10. The polymer or polymeric blend may adhere or bond to other substrates including polyolefins (polypropylene (PP), polyethylene (PE), and the like) and styrenics (polystyrene (PS), acrylonitrile butadiene styrene (ABS), high impact polystyrene (HIPS), and the like).

In an embodiment, the polymer or polymeric blend advantageously exhibits desired properties for low temperature applications. In an exemplary embodiment, the cap assembly 10 has advantageously low temperature performance, such as a cold temperature brittleness point of less than about −80° C., such as less than about −90° C., or even as low as less than about −110° C., as measured by ASTM D746. In a more particular embodiment, the cap assembly 10 has a low temperature flexibility at about −80° C., as measured by ASTM D380.

In an embodiment, the polymer or polymeric blend producing the cap assembly 10 or its components has desirable tube wear characteristics such as minimal spallation (internal) and fouling (external). In particular, spallation results in the generation of particles and debris in the fluid path and fouling results in gumminess and tackiness of the pump head. In a particular embodiment, the cap assembly 10 wear characteristics has a spallation and fouling of less than about 1.0% weight loss when tested using a L/S 17 Cole-Parmer peristaltic standard pump head. Further, the pump life has a dataset that has minimal statistical variation as indicated by standard deviation of less than about 10% of the data mean or average. In an embodiment, the cap assembly 10 has a volumetric flow rate reduction of less than 50%, such as less than about 30% of the initial starting value.

In embodiment, the cap assembly 10 or its components may have further desirable physical and mechanical properties. For instance, the cap assembly 10 or its components may be flexible, kink-resistant and appear transparent or at least translucent. For instance, the cap assembly 10 may have a light transmission greater than about 2%, or greater than about 5% in the visible light wavelength range. In particular, the resulting articles have desirable flexibility and substantial clarity or translucency. For instance, the articles of the polymeric mixture may advantageously produce low durometer articles. For example, an article having a Shore A durometer of between about 35 and about 75, such as between about 55 to about 70 having desirable mechanical properties may be formed. Such properties are indicative of a flexible material.

In addition to desirable hardness, the cap assembly 10 or its components have advantageous physical properties, such as a balance of any one or more of the properties of hardness, flexibility, surface lubricity, pump life, spallation, fouling, tensile strength, elongation, Shore A hardness, gamma resistance, weld strength, and seal integrity to an optimum level.

In an embodiment, the cap assembly 10 or its components have desirable heat stability properties. In a particular embodiment, the cap assembly 10 or its components have one more of the following heat resistance properties such as a higher burst resistance, a higher softening point, and/or a higher autoclaving temperature compared to currently available commercial products.

Applications for the polymer or polymeric blend are numerous. In particular, the polymer or polymeric blend is non-toxic, making the material useful for any application where no toxicity is desired. For example, the polymer or polymeric blend are substantially free of plasticizers or other low-molecular weight extenders that can be leached into the fluids it transfers. "Substantially free" as used herein refers to a polymeric mixture having a total organics content (TOC) (measured in accordance to ISO 15705 and EPA 410.4) of less than about 100 ppm. Further, the polymer or polymeric blend has biocompatibility and animal derived component-free formulation ingredients. For instance, the polymeric mixture has potential for FDA, USP, EP, ISO, and other regulatory approvals. In an exemplary embodiment, the polymer or polymeric blend may be used in applications such as industrial, medical, health care, biopharmaceutical, pharmaceutical, drinking water, food & beverage, laboratory, dairy, and the like. In an embodiment, the polymeric mixture may be used in applications where low temperature resistance is desired. In an embodiment, the polymer or polymeric blend may also be safely disposed as it generates substantially no toxic gases when incinerated and leaches no plasticizers into the environment if land filled.

Many different aspects and embodiments are possible. Some of those aspects and embodiments are described below. After reading this specification, skilled artisans will appreciate that those aspects and embodiments are only illustrative and do not limit the scope of the present invention.

Embodiment 1

A cap assembly for closing an opening in a vessel, the cap assembly comprising: a stopper including an polymer body adapted to fit an opening of a vessel, the stopper also including a tubular portion which defines an internal passageway extending through the polymer body; and a rigid cap attached to and integral with the stopper, wherein the cap is adapted to engage the vessel and provide a sealing force between the stopper and the vessel.

Embodiment 2

A method for forming a cap, the method comprising: forming a stopper including an polymer body adapted to fit an opening of a vessel, the stopper also including a tubular portion which defines an internal passageway extending through the polymer body; and forming a rigid cap attached to and integral with the stopper, wherein the cap is adapted to engage the vessel and provide a sealing force between the stopper and a vessel.

Embodiment 3

The cap assembly or method according to any of the preceding embodiments, wherein the stopper comprises a substantially cylindrical section and a annular flange extending outward in the radial direction from the substantially cylindrical section.

Embodiment 4

A cap assembly or method according to any of the preceding embodiments, wherein the stopper substantially cylindrical section comprises a top surface and a bottom surface and the tubular portion extends axially away from the top surface and the bottom surface.

Embodiment 5

The cap assembly or method according to any of the preceding embodiments, wherein the cap comprises a radial flange defining a central bore, and at least one annular axial flange extending from a radial edge of the radial flange and adapted to contact a opening of the vessel.

Embodiment 6

The cap assembly or method according to embodiment 4, wherein the stopper forms an integral seal with the radial flange of the cap and substantially fills the central bore.

Embodiment 7

The cap assembly or method according to any of the preceding embodiments, wherein the cap comprises a locking mechanism capable of locking and sealing the cap to the vessel, the locking mechanism comprising a catch, a latch, or threadings.

Embodiment 8

The cap assembly or method according to any of the preceding embodiments, wherein at least one of the stopper or the cap is a molded piece.

Embodiment 9

The cap assembly or method according to embodiment 8, wherein the stopper and the cap are a single molded piece.

Embodiment 10

The assembly or method according to any of the preceding embodiments, wherein a surface of the annular axial flange or the radial flange of the cap is sealed to at least one of the substantially cylindrical section or annular flange of the stopper.

Embodiment 11

The cap assembly or method according to any of the preceding embodiments, wherein the assembly further comprises a vessel having a bottom, a sidewall extending from the bottom, wherein the sidewall comprises an opening opposite the bottom for accepting the cap.

Embodiment 12

The cap or method according to any of the preceding embodiments, wherein the vessel comprises at least one of glass, metal, or plastic.

Embodiment 13

The cap assembly or method according to any of the preceding embodiments, wherein the cap comprises an polymer.

Embodiment 14

The cap assembly or method according to any of the preceding embodiments, wherein the stopper and the cap are formed from the same polymer.

Embodiment 15

The cap or method according to any of the preceding embodiments, wherein the stopper and the cap are formed from different polymers.

Embodiment 16

The cap or method according to any of the preceding embodiments, wherein the stopper is formed from a polymer including a fluoropolymer or a thermoplastic elastomer or combinations thereof.

Embodiment 17

The cap assembly or method according to any of the preceding embodiments, wherein the cap is formed from a metal or a polymer including a fluoropolymer or a thermoplastic elastomer or combinations thereof.

Embodiment 18

The cap assembly or method according to any of the preceding embodiments, wherein at least one of the stopper or cap further comprises a silicon compound.

Embodiment 19

The cap assembly or method according to any of the preceding embodiments, wherein the tubular portion has an outer radius that is less than the outer radius of the annular flange of the stopper.

Embodiment 20

The cap assembly or method according to embodiment 5, wherein the annular flange of the stopper has an outer radius that is less than the inner radius of the cap.

Note that not all of the activities described above in the general description or the examples are required, that a portion of a specific activity may not be required, and that one or more further activities may be performed in addition to those described. Still further, the order in which activities are listed is not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

Note that not all of the activities described above in the general description or the examples are required, that a portion of a specific activity may not be required, and that one or more further activities may be performed in addition to those described. Still further, the order in which activities are listed are not necessarily the order in which they are performed.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed:

1. A cap assembly for closing an opening in a vessel, the cap assembly comprising:

a stopper including a polymer body comprising a substantially cylindrical section, the stopper also including more tan one non-concentric tubular portions which defines an internal passageway extending through the polymer body, wherein at least one of the tubular portions and the polymer body are a single molded component, wherein at least one of the tubular portions extends axially away from a top surface and a bottom surface of the polymer body; and a rigid cap attached to or integral with the stopper, wherein the cap is adapted to engage the vessel and provide a sealing force between the stopper and the vessel, wherein the rigid cap comprises a radial flange defining a central bore, wherein the substantially cylindrical section of the stopper comprises a top surface located above an uppermost top surface of the cap in the axial direction down a central axis, and wherein the substantially cylindrical section of the stopper substantially fills the central bore.

2. The cap assembly of claim 1, wherein the stopper comprises an annular flange extending outward in the radial direction from the substantially cylindrical section.

3. The cap assembly of claim 2, wherein the substantially cylindrical section of the stopper comprises a bottom surface and the tubular portions extends axially away from the top surface and the bottom surface.

4. The cap assembly of claim 2, wherein the cap comprises at least one annular axial flange extending from a radial edge of the radial flange and adapted to contact an opening of the vessel.

5. The cap assembly of claim 4, wherein the stopper forms an integral seal with the radial flange of the cap and substantially fills the central bore.

6. The cap assembly of claim 4, wherein a surface of the annular axial flange or the radial flange of the cap is sealed to at least one of the substantially cylindrical section or the annular flange of the stopper.

7. The cap assembly of claim 2, wherein the tubular portions have an outer radius that is less than an outer radius of the annular flange of the stopper.

8. The cap assembly of claim 2, wherein the annular flange of the stopper has an outer radius that is less than an inner radius of the cap.

9. The cap assembly of claim 1, wherein the cap comprises a locking mechanism capable of locking and sealing the cap to the vessel, the locking mechanism comprising a catch, a latch, or threadings.

10. The cap assembly of claim 1, wherein at least one of the stopper or the cap is a molded piece.

11. The cap assembly of claim 10, wherein the stopper and the cap are a single molded piece.

12. An assembly comprising the cap assembly of claim 1, and a vessel, the vessel further comprising a bottom, a sidewall extending from the bottom, wherein the sidewall comprises an opening opposite the bottom for accepting the cap.

13. The assembly of claim 12, wherein the vessel comprises at least one of glass, metal, or plastic.

14. The cap assembly of claim 1, wherein the cap comprises a polymer.

15. The cap assembly of claim 14, wherein the stopper and the cap are formed from the same polymer.

16. The cap assembly of claim 14, wherein the stopper and the cap are formed from different polymers.

17. The cap assembly of claim 1, wherein the polymer body of the stopper includes a fluoropolymer or a thermoplastic elastomer or combinations thereof.

18. The cap assembly of claim 1, wherein the cap is formed from a metal or a polymer including a fluoropolymer or a thermoplastic elastomer or combinations thereof.

19. The cap assembly of claim 1, wherein at least one of the stopper or cap further comprises a silicon compound.

20. The cap assembly of claim 1, wherein the cap comprises polypropylene.

* * * * *